US010526117B2

(12) United States Patent
Huss

(10) Patent No.: US 10,526,117 B2
(45) Date of Patent: Jan. 7, 2020

(54) LID ASSEMBLY AND RELATED CONTAINER FOR FASTENERS

(71) Applicant: THE HILLMAN GROUP, INC., Cincinnati, OH (US)

(72) Inventor: James F. Huss, Scottsdale, AZ (US)

(73) Assignee: THE HILLMAN GROUP, INC., Cincinnati, OH (US)

( * ) Notice: Subject to any disclaimer, the term of this patent is extended or adjusted under 35 U.S.C. 154(b) by 81 days.

(21) Appl. No.: 15/662,904

(22) Filed: Jul. 28, 2017

(65) Prior Publication Data

US 2018/0037382 A1 Feb. 8, 2018

Related U.S. Application Data

(60) Provisional application No. 62/371,485, filed on Aug. 5, 2016.

(51) Int. Cl.

| | |
|---|---|
| ***B65D 51/18*** | (2006.01) |
| ***B65D 35/12*** | (2006.01) |
| ***B65D 35/44*** | (2006.01) |
| ***B65D 39/08*** | (2006.01) |
| ***B65D 47/26*** | (2006.01) |

(52) U.S. Cl.

CPC ..... *B65D 51/18* (2013.01); *B65D 35/12* (2013.01); *B65D 35/44* (2013.01); *B65D 39/08* (2013.01); *B65D 47/261* (2013.01); *B65D 2517/0046* (2013.01)

(58) Field of Classification Search

CPC ..... B65D 51/18; B65D 51/243; B65D 1/10; B65D 39/08

USPC ..... 220/253, 254.8, 256.1, 259.3, 259.4

See application file for complete search history.

(56) References Cited

U.S. PATENT DOCUMENTS

| | | | | |
|---|---|---|---|---|
| 3,125,260 | A | 3/1964 | Dreps | |
| 3,357,605 | A | 12/1967 | Chadfield | |
| 4,643,881 | A * | 2/1987 | Alexander | C02F 1/688 116/200 |
| 5,738,236 | A * | 4/1998 | Brun, Jr. | B65D 47/265 215/309 |
| 5,855,304 | A | 1/1999 | Dean et al. | |
| 5,947,171 | A | 9/1999 | Woodruff | |
| 6,070,751 | A | 6/2000 | Mejias | |
| 6,085,809 | A | 7/2000 | Woodruff | |
| 6,241,128 | B1 | 6/2001 | McClean et al. | |
| 6,305,444 | B1 | 10/2001 | Woodruff | |
| 6,460,718 | B1 | 10/2002 | Vogel | |

(Continued)

FOREIGN PATENT DOCUMENTS

| | | |
|---|---|---|
| CN | 202358458 | 8/2012 |
| CN | 203581589 | 5/2014 |

(Continued)

*Primary Examiner* — Robert Poon

(74) *Attorney, Agent, or Firm* — Thompson Hine LLP

(57) ABSTRACT

A container assembly includes a jar and a lid assembly. The jar includes a body portion defining an interior space for holding items and an upper neck portion disposed about a jar opening leading to the interior space. The lid assembly is connected to the upper neck portion of the jar and includes an inner lid component and an outer lid component. The outer lid component is rotatable relative to the inner lid component while the inner lid component remains stationary relative to the upper neck portion of the jar.

16 Claims, 21 Drawing Sheets

(56) References Cited

U.S. PATENT DOCUMENTS

| | | | |
|---|---|---|---|
| 6,543,496 | B2 | 4/2003 | Woodruff |
| 6,547,102 | B2 | 4/2003 | Stoneberg |
| 6,612,451 | B2 | 9/2003 | Tobias et al. |
| 6,615,473 | B2 | 9/2003 | McClean et al. |
| 6,732,772 | B2 | 5/2004 | Woodruff |
| 6,732,875 | B2 | 5/2004 | Smith et al. |
| 6,739,471 | B2 | 5/2004 | Goetz et al. |
| 6,757,957 | B2 | 7/2004 | McClean et al. |
| 7,032,756 | B2 | 4/2006 | Wylie |
| 7,073,546 | B2 | 7/2006 | Woodruff |
| 7,150,378 | B2 | 12/2006 | Dean et al. |
| 7,156,251 | B2 | 1/2007 | Smith et al. |
| 7,159,732 | B2 | 1/2007 | Smith et al. |
| 7,246,715 | B2 | 7/2007 | Smith et al. |
| 7,543,713 | B2 | 6/2009 | Trude et al. |
| 7,699,171 | B2 | 4/2010 | Rivera et al. |
| 7,731,047 | B2 | 6/2010 | Ishimitsu |
| 7,766,197 | B2 | 8/2010 | Getsy |
| D641,246 | S | 7/2011 | Maas et al. |
| 7,980,404 | B2 | 7/2011 | Trude et al. |
| 8,047,392 | B2 | 11/2011 | Eiten et al. |
| 8,235,214 | B2 | 8/2012 | Eiten et al. |
| 8,251,240 | B2 | 8/2012 | Seelhofer |
| 8,393,487 | B1 | 3/2013 | Pillers et al. |
| 8,528,768 | B2 | 9/2013 | D'Amato |
| 8,529,975 | B2 | 9/2013 | Trude et al. |
| 8,544,649 | B2 | 10/2013 | Rivera et al. |
| 8,584,879 | B2 | 11/2013 | Melrose et al. |
| 8,839,972 | B2 | 9/2014 | Trude et al. |
| D722,885 | S | 2/2015 | Mooney et al. |
| 8,955,705 | B2 | 2/2015 | Vogel et al. |
| D760,085 | S | 6/2016 | Su et al. |
| 9,434,508 | B2 | 9/2016 | Su et al. |
| 2003/0196926 | A1* | 10/2003 | Tobias ..... B65D 1/0284 206/509 |
| 2003/0221987 | A1 | 12/2003 | Trude |
| 2006/0000832 | A1 | 1/2006 | Smith et al. |
| 2008/0029512 | A1 | 2/2008 | Smith et al. |
| 2008/0128417 | A1 | 6/2008 | Smith et al. |
| 2008/0296297 | A1 | 12/2008 | Ohashi |
| 2010/0018975 | A1* | 1/2010 | DeMarco ..... B65D 47/265 220/253 |
| 2010/0237083 | A1 | 9/2010 | Trude et al. |
| 2011/0089174 | A1 | 4/2011 | Smith et al. |
| 2011/0147392 | A1 | 6/2011 | Trude et al. |
| 2011/0226768 | A1 | 9/2011 | Sexton et al. |
| 2012/0037669 | A1 | 2/2012 | Goetz et al. |
| 2012/0132611 | A1 | 5/2012 | Trude et al. |
| 2013/0000259 | A1 | 1/2013 | Trude et al. |
| 2015/0114964 | A1 | 4/2015 | Vogel et al. |
| 2016/0009449 | A1 | 1/2016 | Su et al. |

FOREIGN PATENT DOCUMENTS

| | | |
|---|---|---|
| CN | 203727859 | 7/2014 |
| CN | 104411593 | 3/2015 |
| GB | 1041944 | 9/1966 |
| JP | 9-58673 | 3/1997 |
| JP | H1111451 | 1/1999 |
| TW | 588730 | 5/2004 |
| TW | M365323 | 9/2009 |
| TW | M401380 | 4/2011 |
| WO | WO 2016012165 | 1/2016 |

* cited by examiner

LID ASSEMBLY AND RELATED CONTAINER FOR FASTENERS

TECHNICAL FIELD

This application relates generally to containers for fasteners, such as screws, and more particularly to a container with a closeable lid assembly.

BACKGROUND

Packaged fasteners are often sold in boxes, jars and buckets, with larger quantities of more commonly sold in jars and buckets. Typical fastener jars may be of the 5 pound size or 10 pound size, but other variations are possible. Ease of jar opening, access, uses and reclosing for later use are all important to contractors on the job site, and commonly available jars have limitations in one or more of these areas.

Accordingly, it would be desirable to provide a fastener jar and lid assembly that improves the contractor experience.

SUMMARY

In one aspect, as seen in the attached drawings, the container includes a two-component lid assembly movable between item retain and item dispense positions, and stacking feet projecting downwardly from the bottom of the container to facilitate stacking of one container atop another.

In another aspect, a container assembly includes a jar with a body portion defining an interior space for holding items and an upper neck portion disposed about a jar opening leading to the interior space, where the upper neck portion includes an exterior thread arrangement. A lid assembly is threadedly connected onto the upper neck portion of the jar so as to be removable by unthreading, where the lid assembly includes an inner lid component and an outer lid component, and the outer lid component is rotatable relative the inner lid component.

In another aspect, a container assembly includes a jar and a lid assembly. The jar includes a body portion defining an interior space for holding items and an upper neck portion disposed about a jar opening leading to the interior space. The lid assembly is connected onto the upper neck portion of the jar, and the lid assembly includes an inner lid component and an outer lid component. The inner lid component includes a top wall partially covering the jar opening and having an access opening therein. The outer lid component includes a top wall partially covering the jar opening and having an access opening therein. The outer lid component is rotatable relative to the inner lid component between an item dispense position and an item retain position. In the item dispense position the access opening of the outer lid component at least partially overlaps with the access opening of the inner lid component to provide access to the interior space of the jar, and in the item retain position the access opening of the outer lid component does not overlap with the access opening of the inner lid component such that the jar opening is completely covered by the lid assembly.

In a further aspect, a container assembly includes a jar and a lid assembly. The jar includes a body portion defining an interior space for holding items and an upper neck portion disposed about a jar opening leading to the interior space. The lid assembly is connected to the upper neck portion of the jar and includes an inner lid component and an outer lid component. The outer lid component is rotatable relative to the inner lid component while the inner lid component remains stationary relative to the upper neck portion of the jar.

In yet another aspect, a lid assembly for a container includes an inner lid component and an outer lid component. The inner lid component is retained within a bottom interior of the outer lid component. The outer lid component is rotatable relative to the inner lid component between a dispense position and a retain position. In the dispense position an opening in a top of the inner lid component aligns with an opening in a top of the outer lid component. In the retain position the opening in the top of the inner lid component does not align or overlap with the opening in the top of the outer lid component. The inner lid component and the outer lid component collectively include a set of interacting stops that limit rotation of the outer lid component relative to the inner lid component to no more than two hundred and ten circumferential degrees.

The details of one or more embodiments are set forth in the accompanying drawings and the description below. Other features, objects, and advantages will be apparent from the description and drawings, and from the claims.

DETAILED DESCRIPTION

Figure 1:
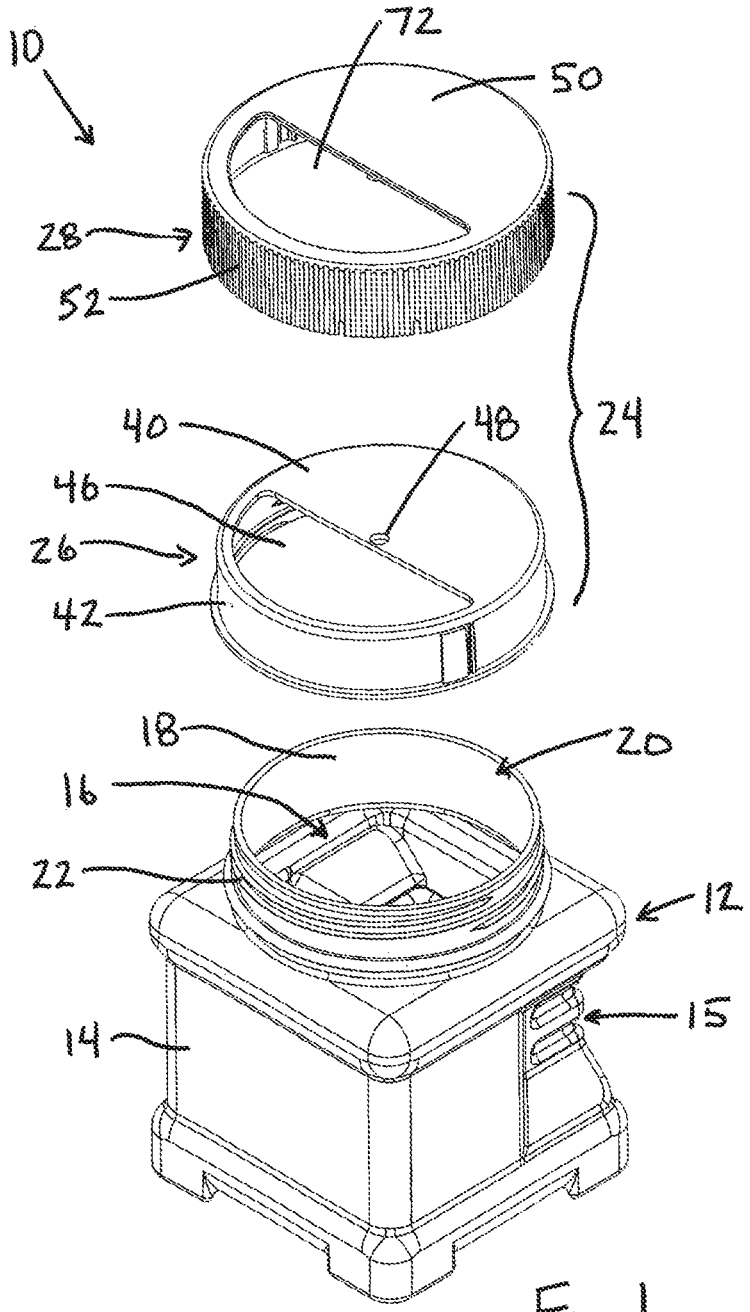
FIG. 1 is an exploded perspective of one embodiment of a container assembly.

Referring to FIGS. 1-13, a container assembly 10 is shown and includes a jar 12 (e.g., of transparent or translucent plastic or other suitable material) including a body portion 14 defining an interior space 16 for holding items (e.g., screws or other fasteners) and an upper neck portion 18 disposed about a jar opening 20 leading to the interior space 16. The upper neck portion 18 includes an exterior thread arrangement 22. A lid assembly 24 threadedly connects onto the upper neck portion 18 of the jar 12 so as to be removable by unthreading. The lid assembly includes an inner lid component 26 and an outer lid component 28, which may typically connect together so that the components are rotatable relative to each other but are not intended to be separated from each other. Here, and as described in more detail below, the inner lid component 26 is retained within a bottom interior of the outer lid component 28.

The jar 12 includes a bottom surface portion 30 that, in the illustrated embodiment, is substantially planar, and a plurality of feet 32 extending downwardly below the bottom surface portion 30. The plurality of feet 32 are arranged to permit stacking of containers in such a manner that the feet of an upper container assembly extend downward alongside the lid assembly of a lower container assembly and thus interact with the lid assembly of the lower container assembly so as to inhibit the upper jar from sliding off the lower lid assembly. In the illustrated embodiment, the jar is generally four-sided and four feet are provided, each foot located at a respective corner of the jar, but variations are possible. The jar body 14 includes an indented grip region 15 with reduced lateral dimension and to facilitate one-handed gripping by a user.

The inner lid component 26 includes a top portion 40 and a mount collar portion 42 extending downward from the top portion 40. Here, the top portion 40 is in the form of a top wall that is substantially planar, but other variations are possible. The mount collar portion 42 has an interior thread arrangement 44 that is configured to engage with the exterior thread arrangement 22 of the upper neck portion 18 of the jar 12. The top portion 40 is configured to, in part, cover the jar opening 20 and includes an access opening 46 having an area (e.g., in top or bottom plan view) that may be between about ⅓ and about ½ of an area (e.g., in top or bottom plan view) of the jar opening 20. An additional opening 48 that is substantially smaller than opening 46 and may be centrally located along a rotational axis of the inner lid component 26.

The outer lid component 28 including a top portion 50 and a mount collar portion 52 extending downward from the top portion 50. The top portion 50 is in the form of a top wall that is substantially planar, but other variations are possible. The mount collar portion 52 is sized to be disposed about the mount collar portion 42 when the lid components are connected together for use. The inner side of the mount collar portion 52 includes a plurality of circumferentially spaced apart inwardly extending tabs 54. Each tab 54 is disposed between a respective set of slots 56 in the mount collar portion 52 that provide for slight radially outward flexing when the outer lid component is moved downward onto the inner lid component and a cam surface 58 of the tab engages a peripheral rim 60 at the bottom of the mount collar portion 42, enabling each tab to be disposed beneath the radially outwardly projecting peripheral rim 60 (per FIG. 7). The mount collar portion 52 includes an inwardly projecting inner rim 62 having a lower side adjacent a top side of the outwardly projecting peripheral rim 60 such that the peripheral rim 60 is sandwiched between the inner rim and the tabs 54.

The top portion 50 includes a pin component 70 projecting downwardly therefrom and positioned to be disposed within the additional opening 48 of the top portion 40 when the lid components are connected together, which arrangement helps to provide proper alignment between the inner lid component 26 and the outer lid component 28. However, the embodiments in which the pin 70 and opening 48 are eliminated are also contemplated. The top portion 50 also includes an access opening 72, which here has an area (e.g., in top or bottom plan view) that, here, is substantially the same as the area of the access opening 46 of the inner lid component, with a corresponding matching shape so that the two openings 72 and 46 can nicely align with peripheries closely matched. In other embodiments the area and shape of the openings 72 and 46 could be different than each other, if desired.

The threaded engagement between the inner lid component and the jar neck holds the lid assembly onto the jar when the lid assembly is tightened onto the jar (e.g., by rotating the lid assembly onto the jar with clockwise rotation). As mentioned above, the outer lid component 28 is rotatable relative to the inner lid component 26, which enables movement of the outer lid component between an item dispense position of the outer lid component (e.g., FIG. 1) and an item retain position of the outer lid component (e.g., FIG. 9—where the jar is not shown). In the item dispense position the access openings 46 and 72 overlap (and here substantially align) to provide access to the interior space 16 of the jar. In the item retain position the access opening 72 does not overlap with the access opening 46, such that the jar opening is completely covered by the lid assembly because top portion 50 blocks the access opening 46 and top portion 40 blocks the access opening 72.

Figure 12A:
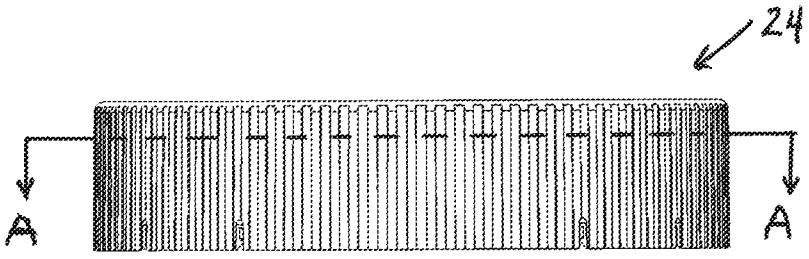
FIG. 12A is a side elevation of the lid assembly.
Figure 12B:
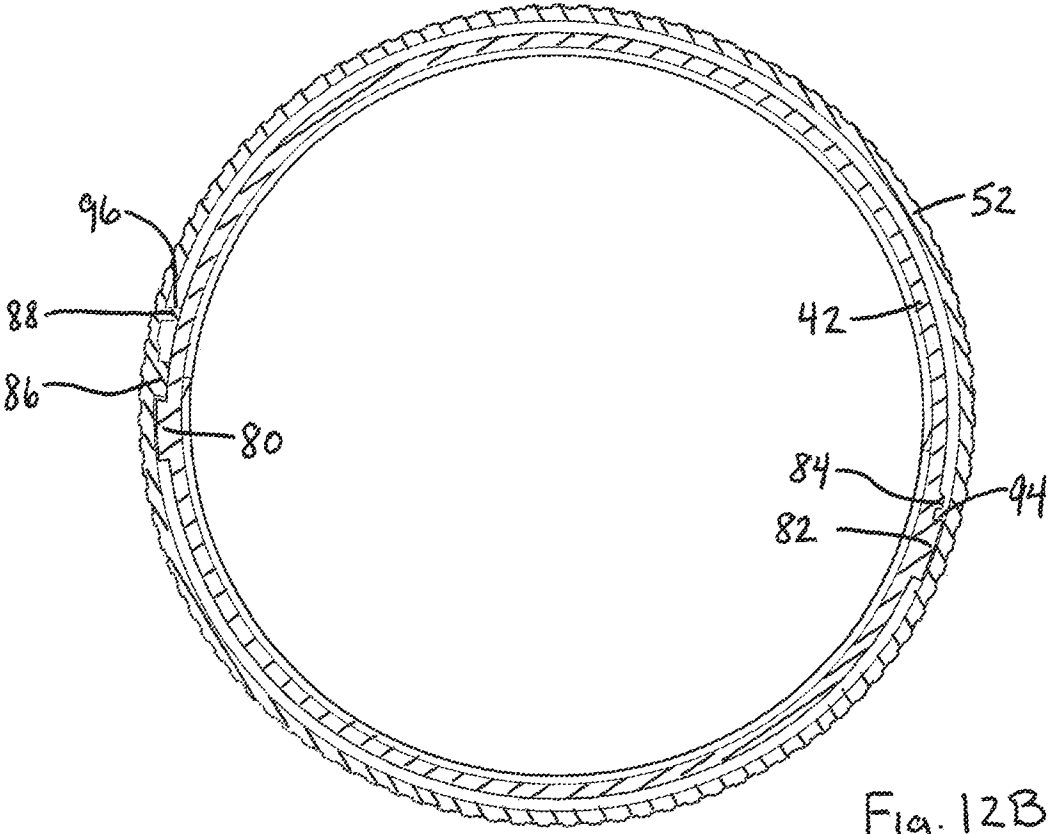
FIG. 12B is a cross-section taken along line A-A of FIG. 12A with an assumed item dispense position of the outer lid component.
Figure 12C:
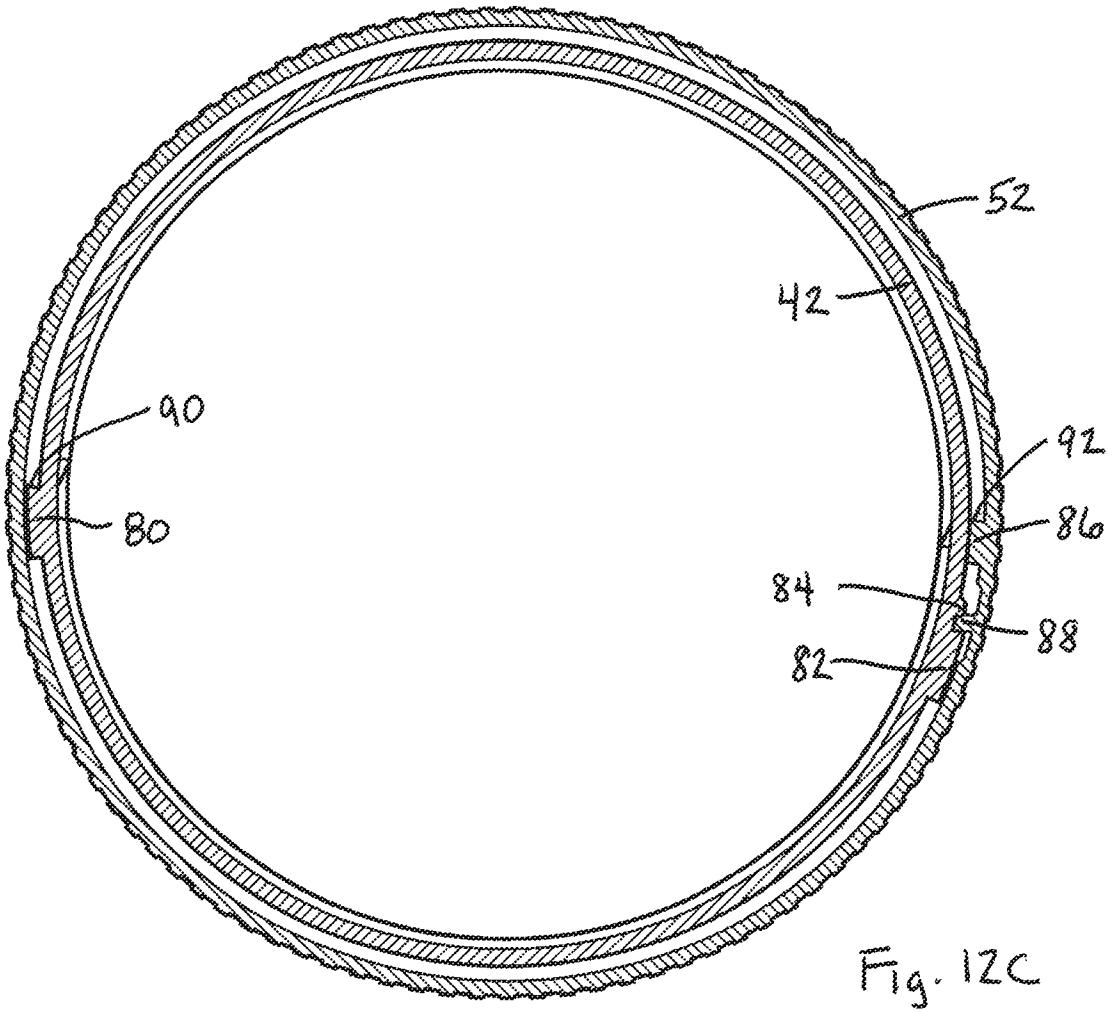
FIG. 12 C is a cross-section taken along line A-A of FIG. 12B with an assumed item retain position of the outer lid component.

As seen with reference to FIGS. 12A-12C, where FIG. 12B represents a cross-section along line A-A of FIG. 12A when the outer lid component is in the item dispense position and FIG. 12C represents a cross-section along line A-A of FIG. 12A when the outer lid component is in the item retain position, the outer lid component and inner lid component including interacting features for limiting rotational movement of the outer lid component relative to the inner lid component.

In particular, the mount collar portion 42 of the inner lid component includes an outwardly projecting stop 80, a circumferentially spaced outwardly projecting stop 82 and an outwardly projecting detent 84 proximate the stop 82. The mount collar portion 52 of the outer lid component includes an inwardly projecting stop 86 and an inwardly projecting stop 88. In the item dispense position of the outer lid component 28 (per the cross-section of FIG. 12B which shows a top down cross-section view), the stop 86 of the outer lid component engages the stop 80 of the inner lid component, defining a limit of the amount of counterclockwise rotation (when viewed from the top as in the cross-section of FIG. 12B) of the outer lid component 28 relative to the inner lid component 26.

When the outer lid component is in the item retain position (per the cross-section of FIG. 12C which shows a top down cross-section view), here achieved by clockwise rotation of the outer lid component, (i) the stop 88 of the outer lid component becomes disposed in the gap between the detent 84 of the inner lid component and the stop 82 of the inner lid component, and (ii) when moving in the counterclockwise rotational direction (when viewed from the top as in the cross-section of FIG. 12C) that would move the outer lid component from the item retain position to the item dispense position, the detent 84 of the inner lid component is positioned between the stop 88 of the outer lid component and the stop 80 of the inner lid component, with the detent 84 being adjacent stop 88 and the circumferential extent between the detent 84 and the stop 80 (when moving counterclockwise) being more than one-hundred eighty degrees.

The stop 80 of the inner lid component includes a stop surface 90 that angles away from the counterclockwise rotational direction (in top down view), and the stop 86 of the outer lid component includes a stop surface 92 that angles toward the counterclockwise rotational direction, which helps prevent the stop 86 from being rotated past the stop 80 even when significant counterclockwise rotational force is applied to the outer lid component (e.g., when the lid assembly is being untightened in order to disengage the lid assembly from the jar entirely). The stop 82 of the inner lid component includes a stop surface 94 that angles toward the counterclockwise rotational direction, and the stop 88 of the outer lid component includes a stop surface 96 that angles away from the counterclockwise rotational direction, which helps prevent the stop 88 from being rotated past the stop 82 even when significant clockwise rotational force is applied to the outer lid component (e.g., when the lid assembly is being tightly threaded onto the jar). Notably, the outward projection of the detent 84 is less than stop 82, and the shape of the detent 84 permits the stop 88 to pass by the detent 84 if sufficient rotational force is applied to the outer lid component. However, the detent 84 interacts with the stop 88 to hold the outer lid component in the retain position until an intentional and sufficient counterclockwise force is applied to the outer lid component.

Also notable is that the described configuration prevents the stop 86 of the outer lid component from ever being moved into contact with the 82 stop of the inner lid component.

Figure 2:
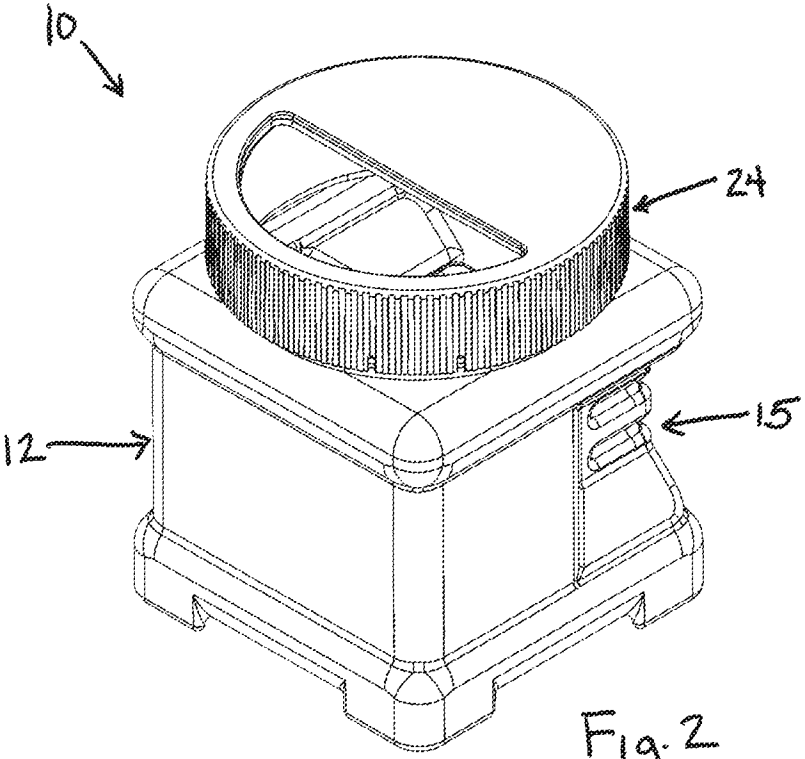
FIG. 2 is a perspective view of the container assembly when assembled.
Figure 3:
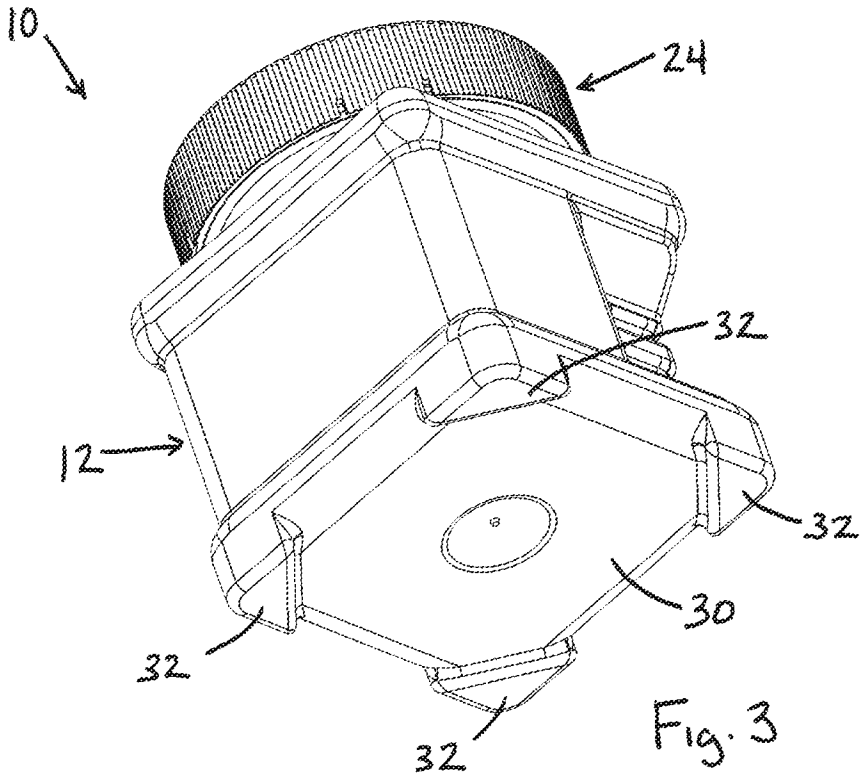
FIG. 3 is a bottom perspective view of the container assembly.
Figure 4:
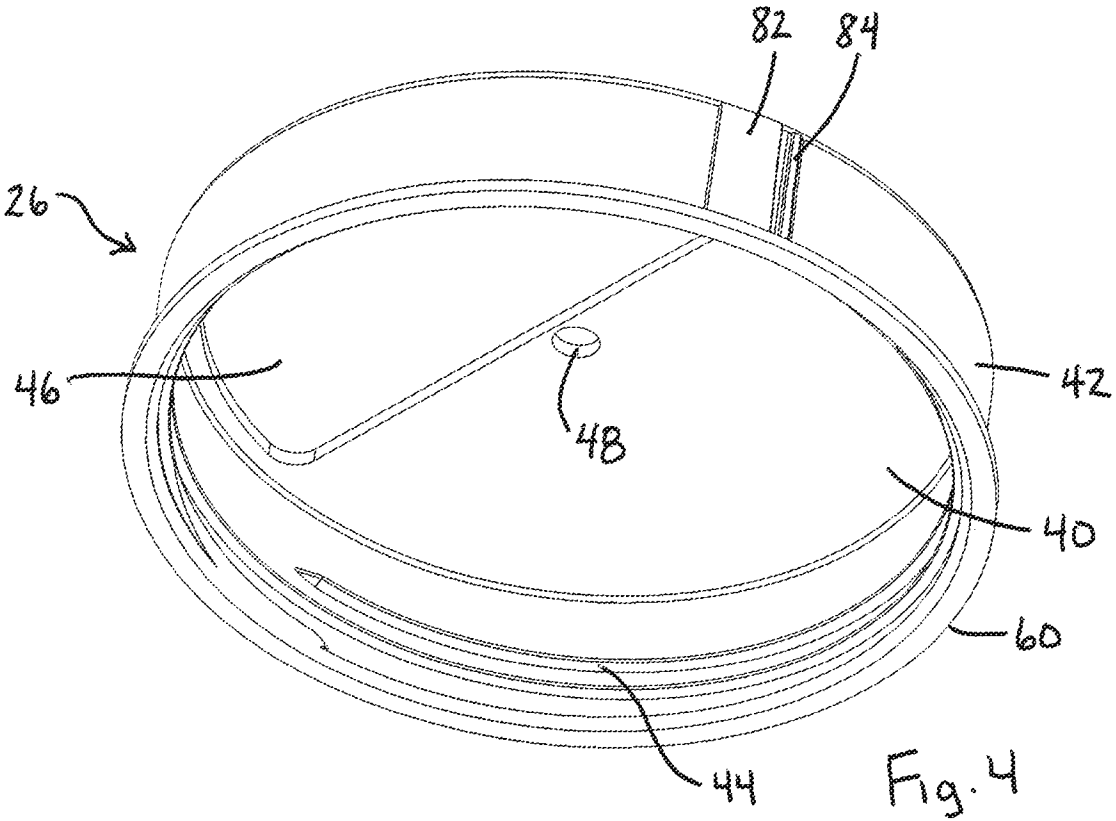
FIG. 4 is a bottom perspective view of an inner lid component.
Figure 5:
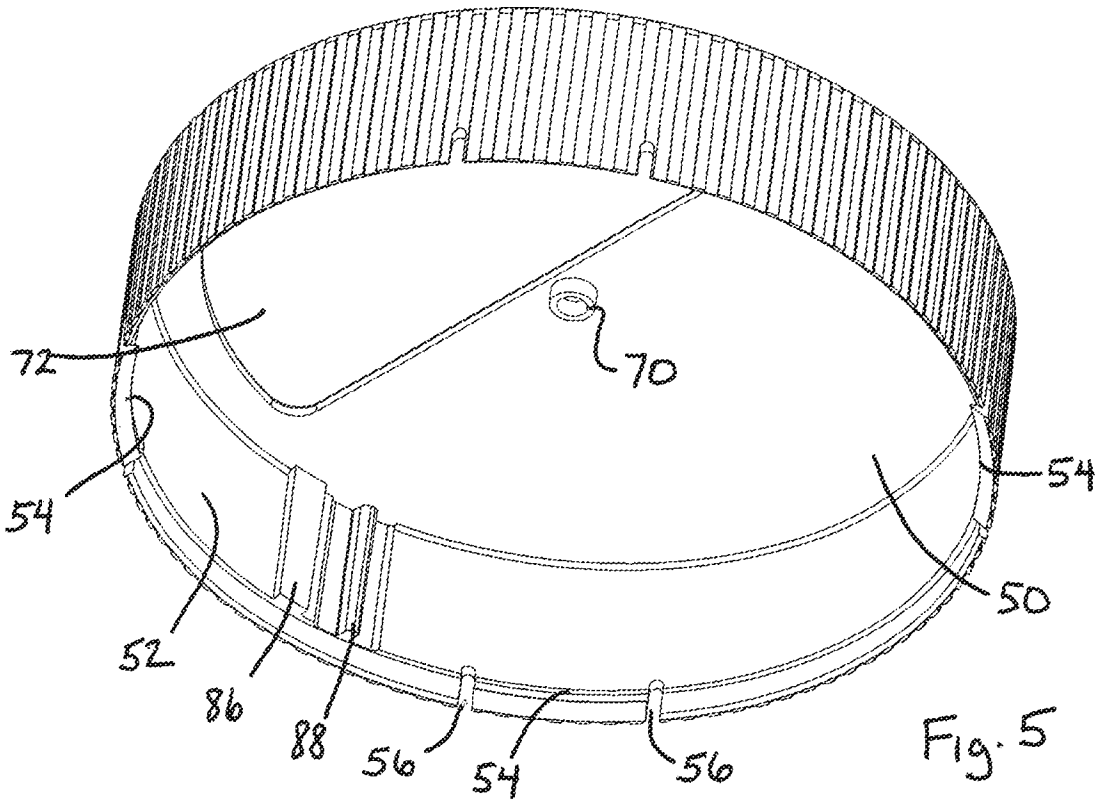
FIG. 5 is a bottom perspective view of an outer lid component.
Figure 6:
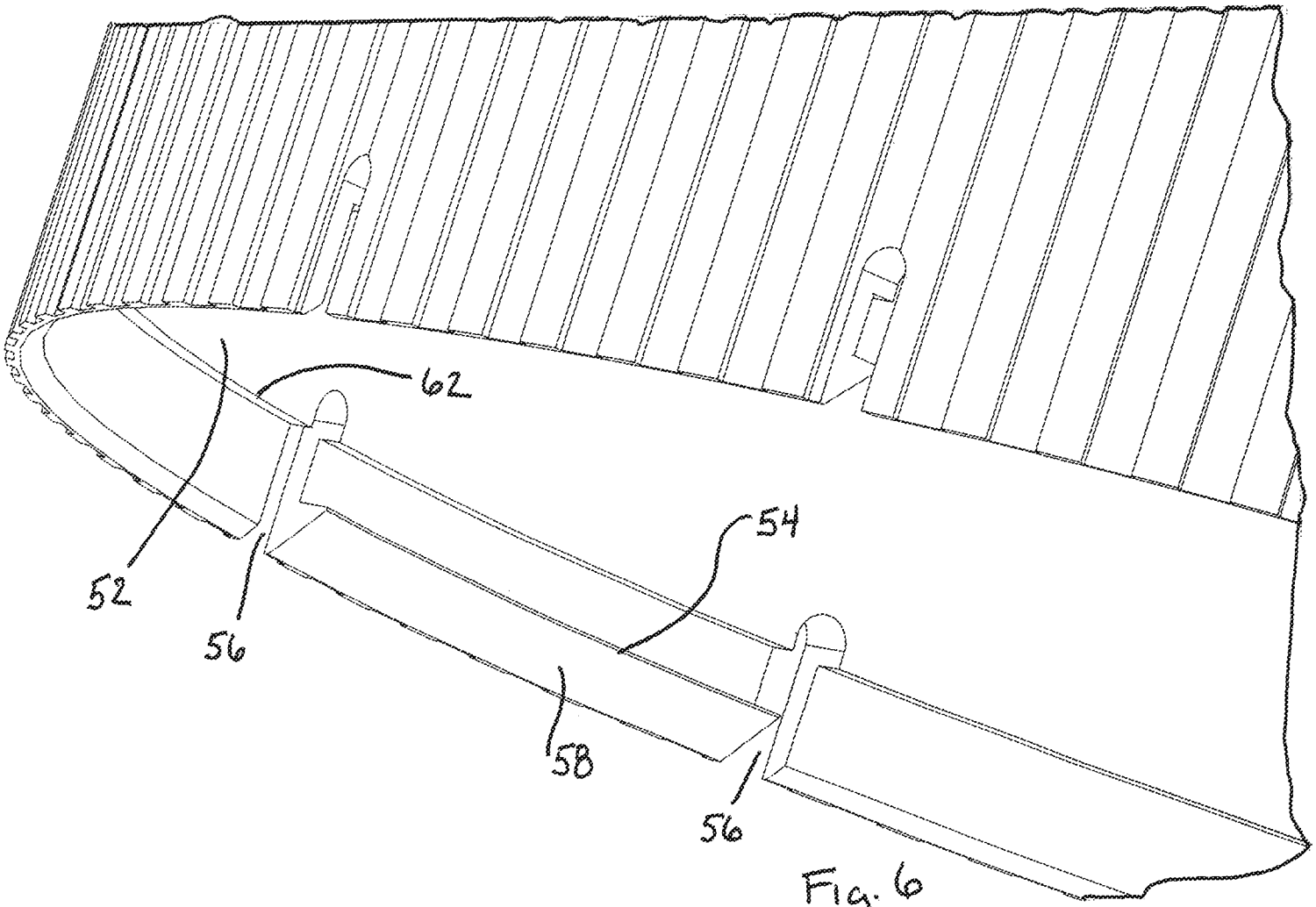
FIG. 6 is a partial perspective of the outer lid component showing inwardly projecting tabs.
Figure 7:
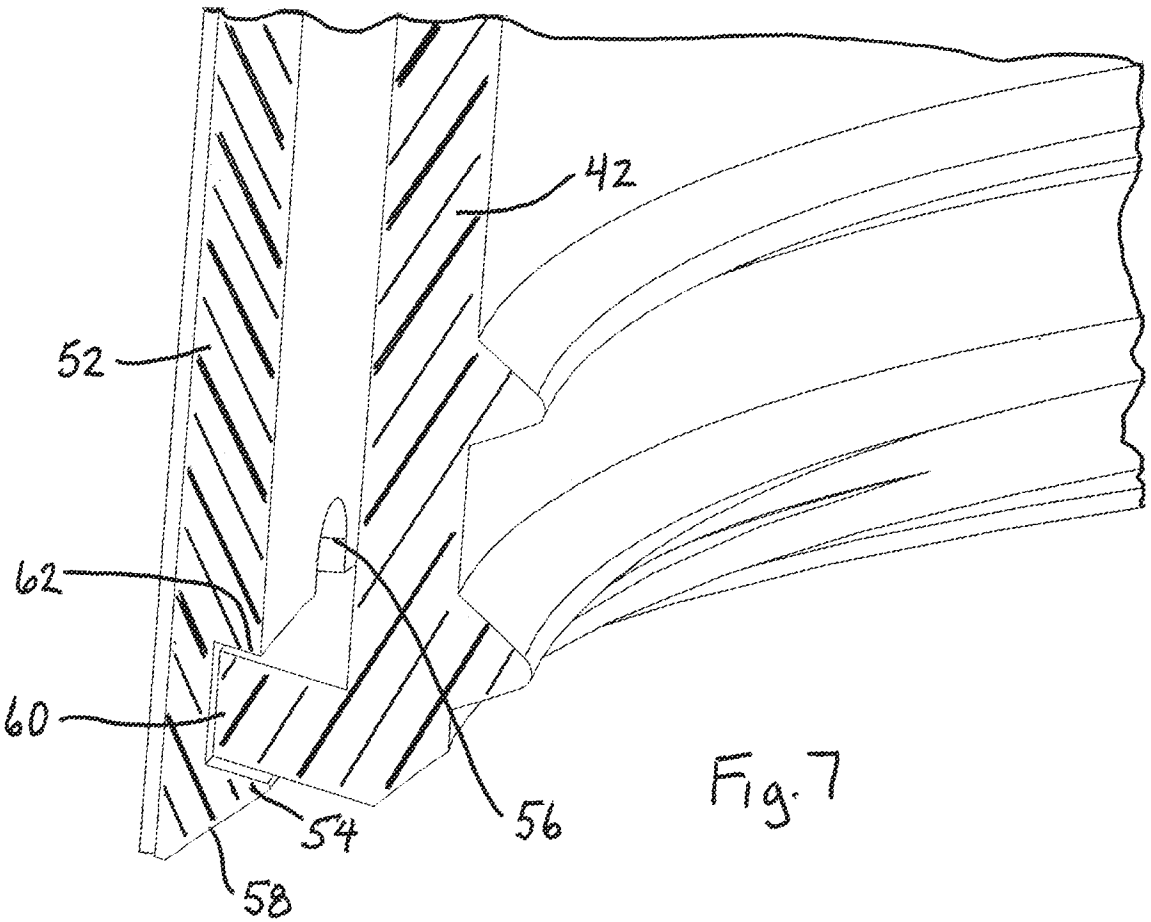
FIG. 7 is a partial cross-section of a lid assembly shown engagement between a tab on the outer lid component and a rim on the inner lid component.
Figure 8:
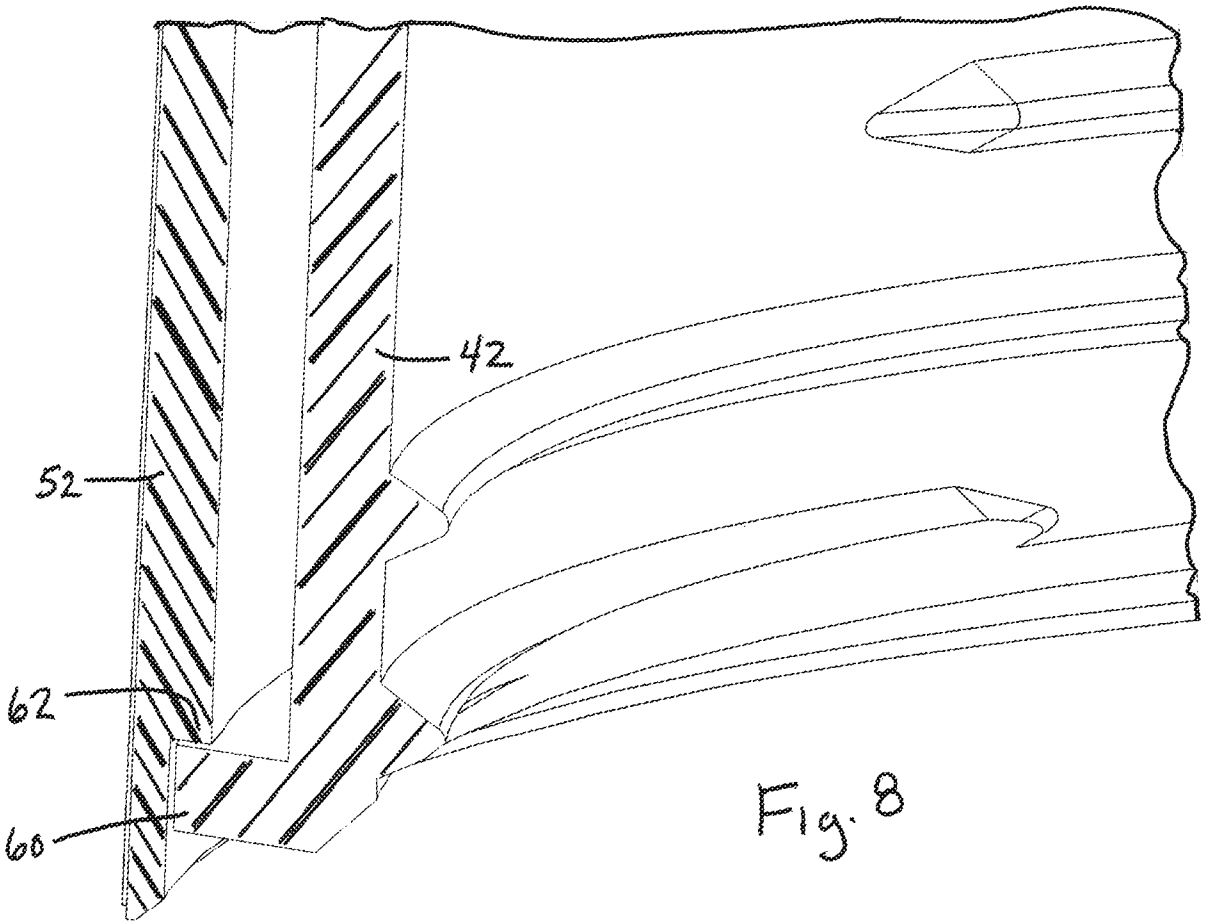
FIG. 8 is a partial cross-section of the lid assembly in a region spaced from the tabs.
Figure 9:
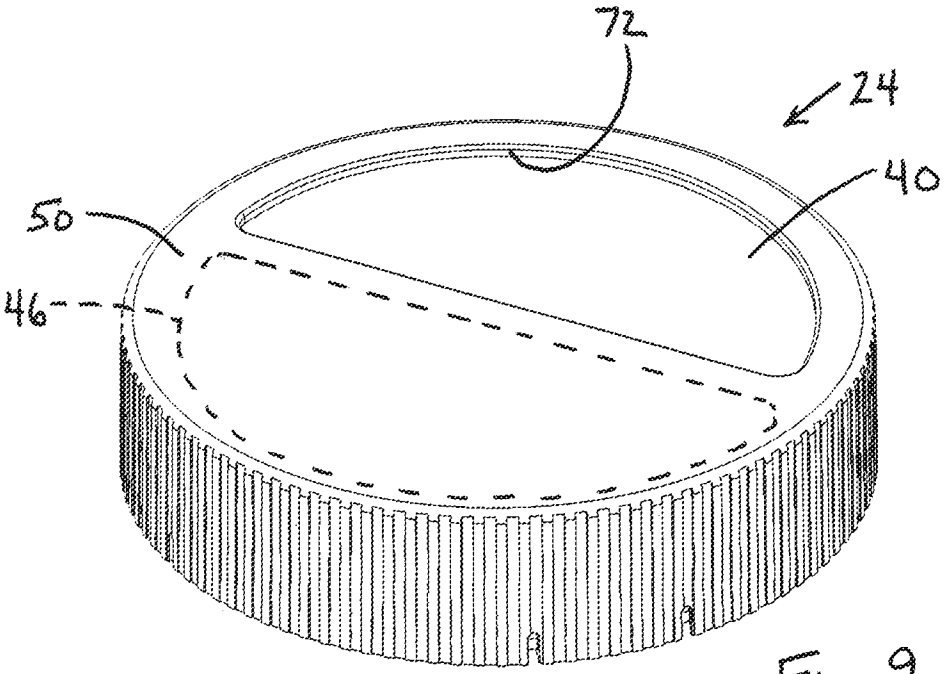
FIG. 9 is a perspective view of the lid assembly with the outer lid in an item retain position.
Figure 10:
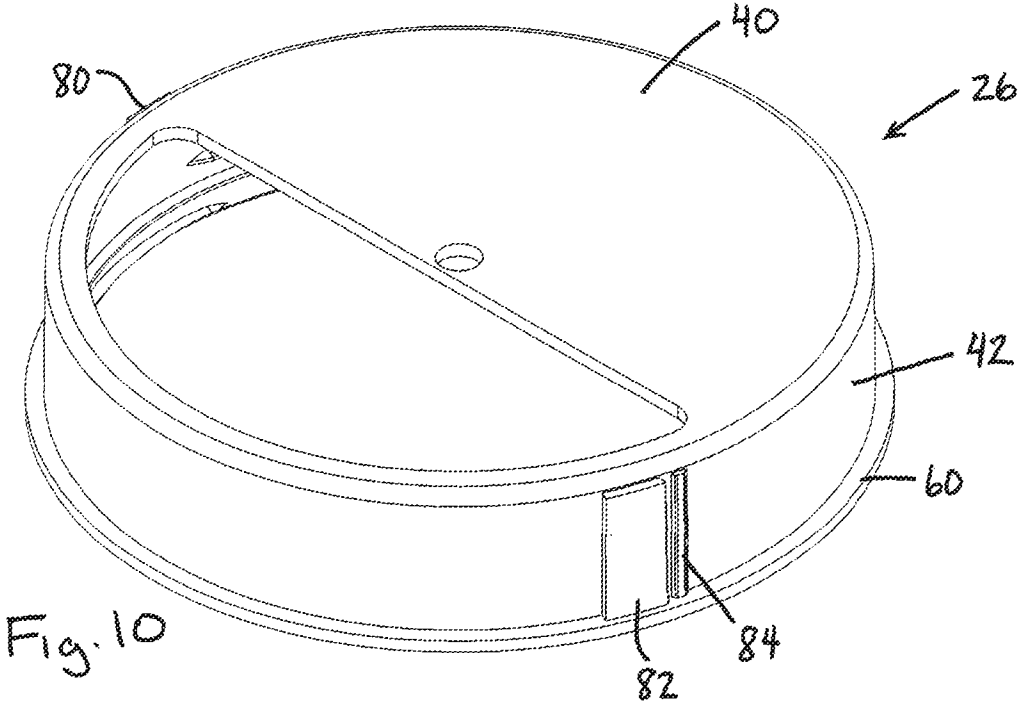
FIG. 10 is a perspective view of the inner lid component.
Figure 11:
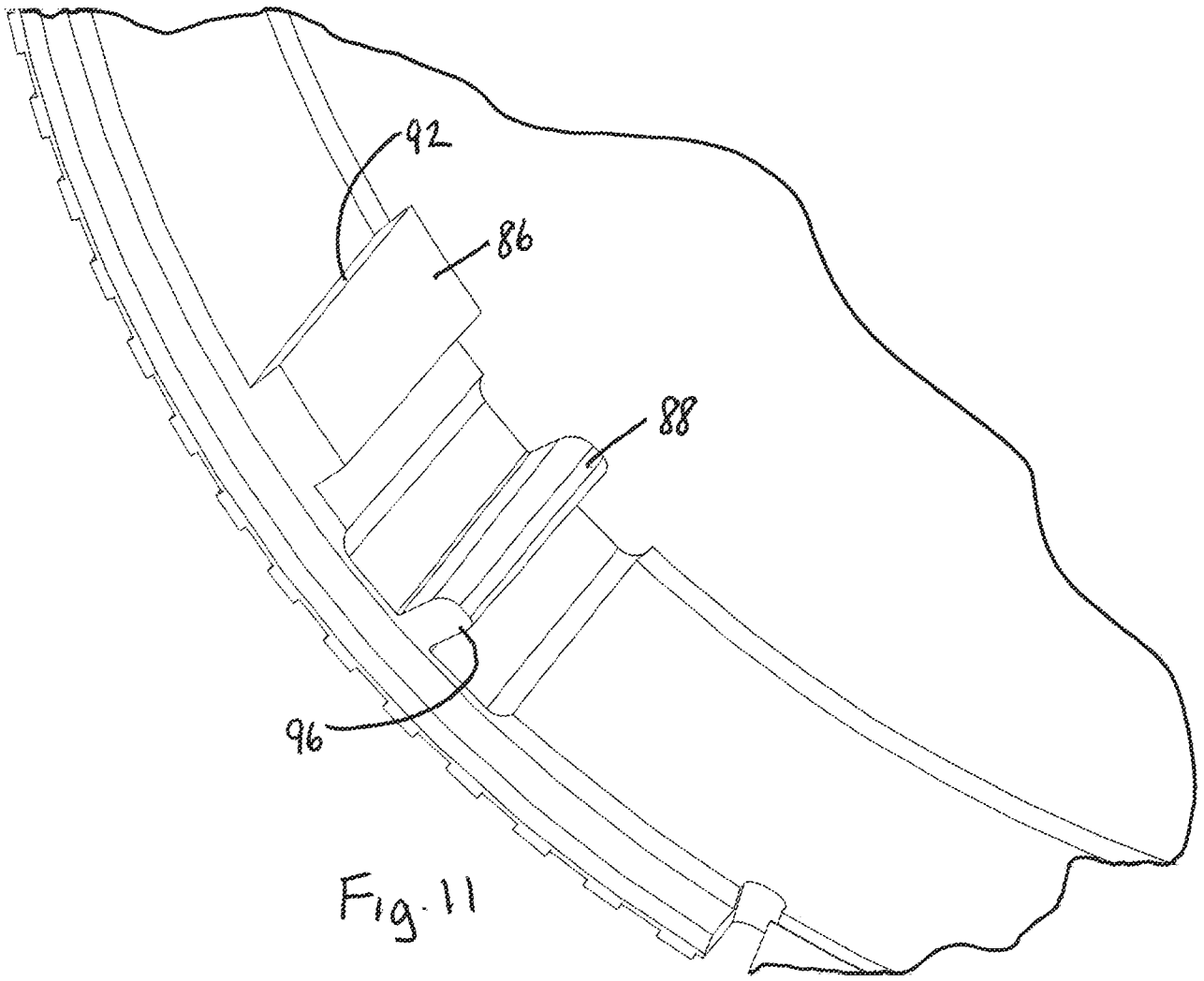
FIG. 11 is a partial interior perspective view of the outer lid component.
Figure 13:
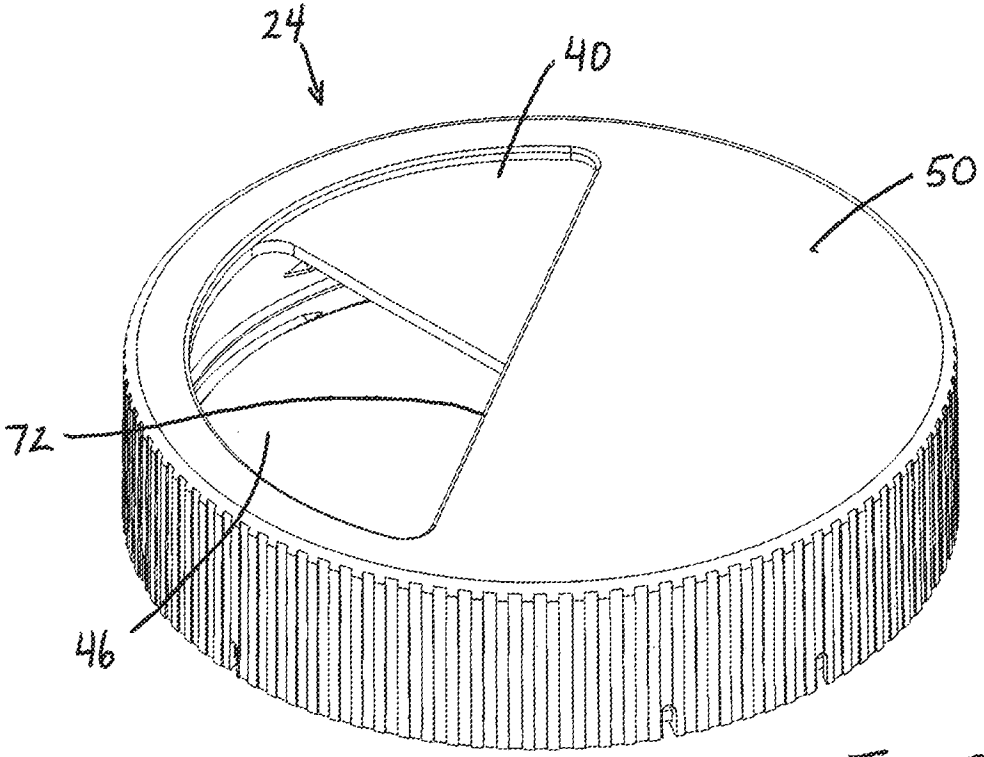
FIG. 13 is a perspective view of the lid assembly in a partially open condition.
Figure 14:
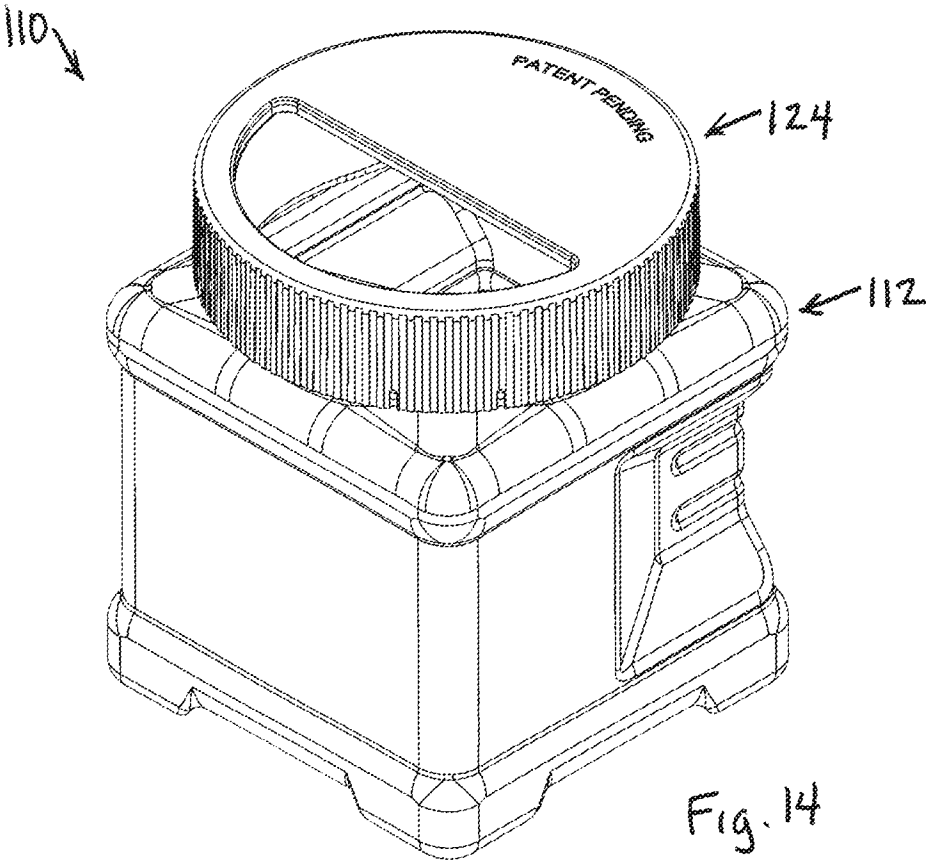
FIG. 14 is perspective view of another container assembly.
Figure 15:
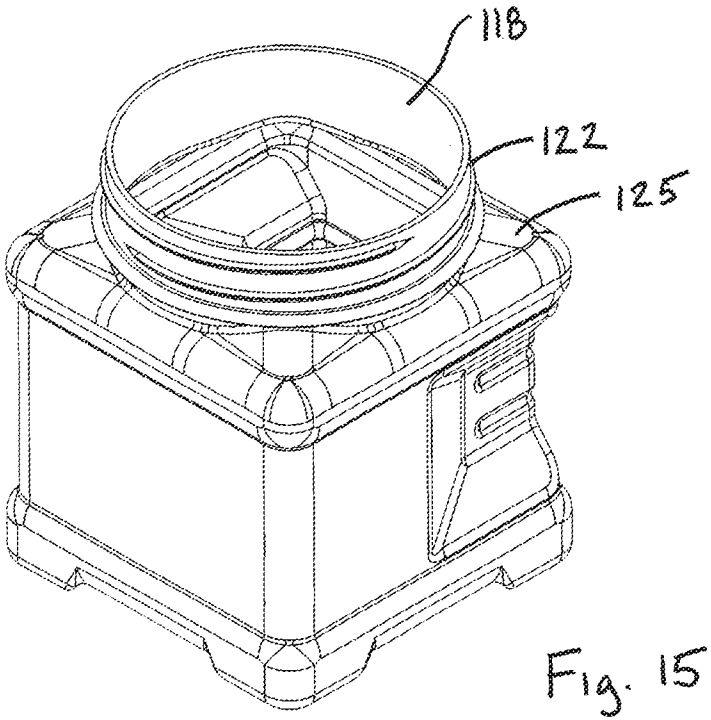
FIG. 15 is a perspective view of the jar of the container assembly of FIG. 14.
Figure 16:
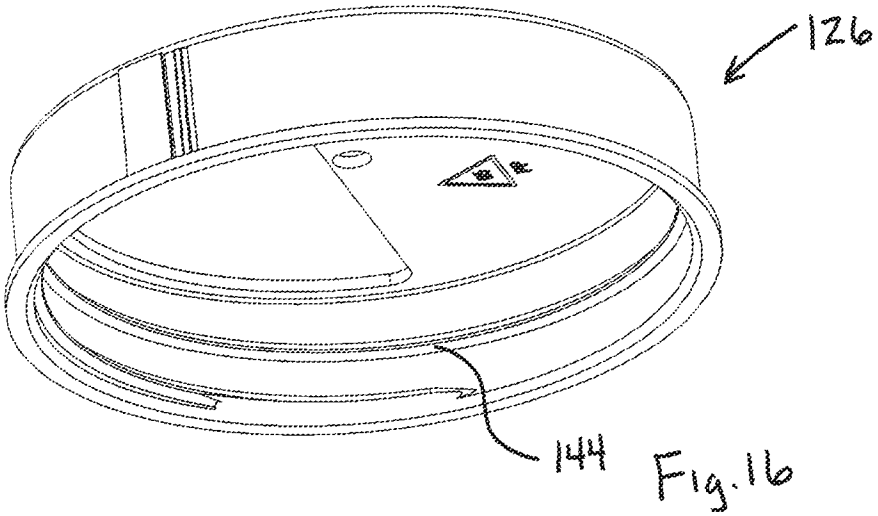
FIG. 16 is a perspective view of the inner lid component of the container assembly of FIG. 14.
Figure 17:
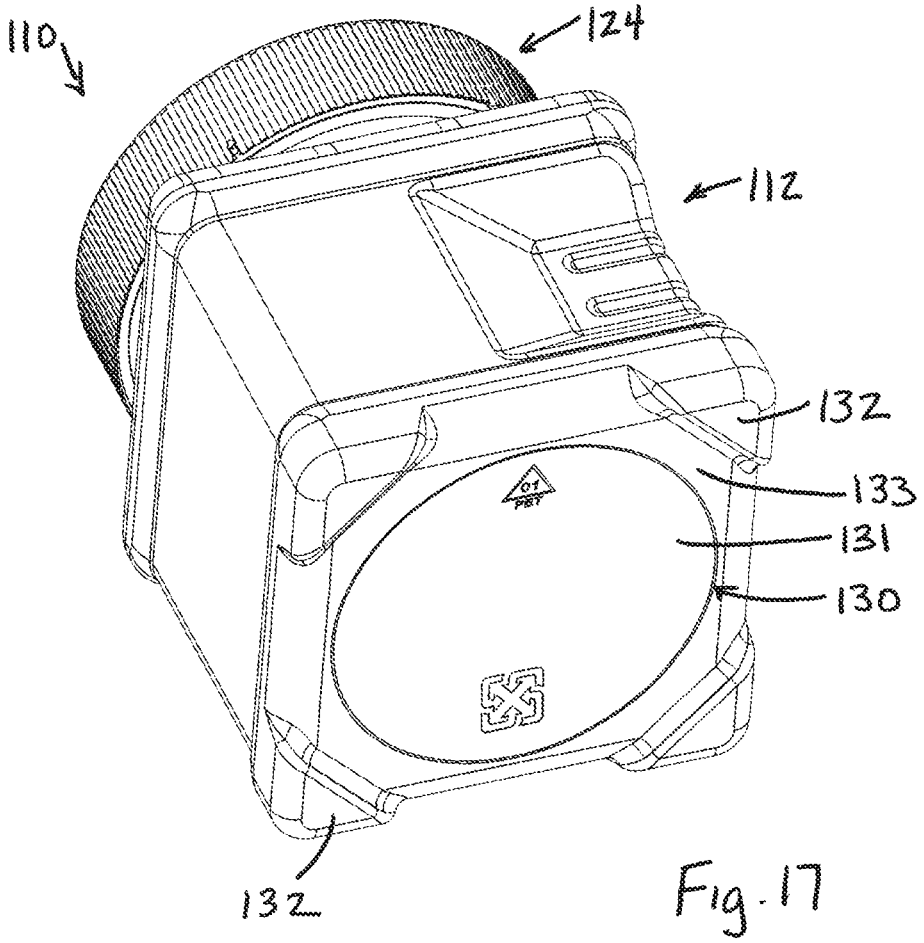
FIG. 17 is a bottom perspective view of the container assembly of FIG. 14.

An exemplary sequence of clockwise rotation of the outer lid component to move the outer lid component from the item dispense position to the item retain position can be seen by sequential depiction of FIGS. 2, 13 and 9 (in that order).

It is to be clearly understood that the above description is intended by way of illustration and example only, is not intended to be taken by way of limitation, and that other changes and modifications are possible.

For example, FIGS. 14-17 show another embodiment of a container assembly 110 in which the jar 112 includes an upper wall portion 125 surrounding the upper neck portion 118, where upper wall portion 125 includes corner regions that taper upwardly when moving toward the neck (as compared to jar 12 in which the upper wall portion is substantially planar). In addition the threaded regions 122 and/or 144 of the jar and inner lid component respectively are configured as single start thread to ensure the lid assembly opening would always be at the side of the jar opposite the grip portion (as compared to the dual start threads 22 and 44 in container assembly 10). The bottom wall 130 of the jar includes an interior circular upwardly domed portion 131 surrounded by a rim 133, where corner located stacking feet 132 extend downward.

Figure 18:
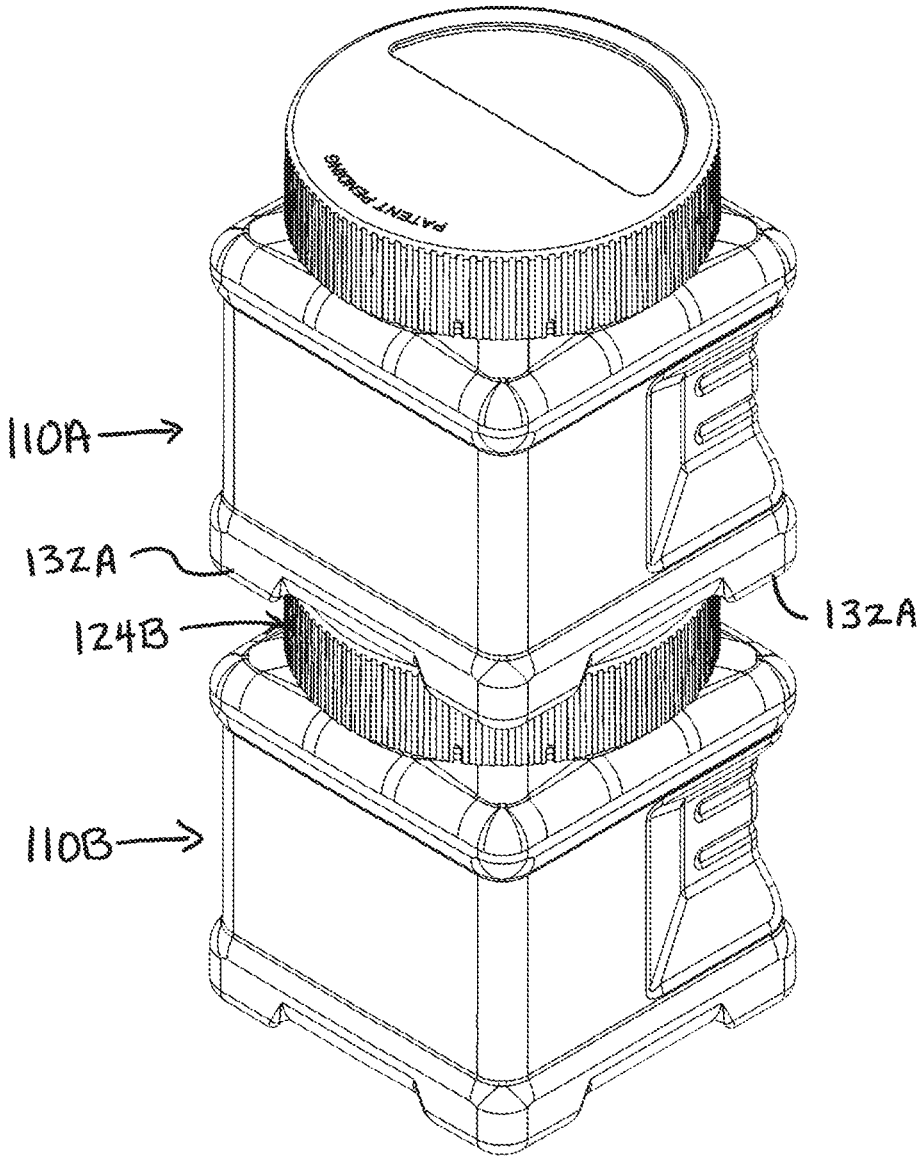
FIG. 18 is a perspective view of a stacked set of container assemblies of the type shown in FIG. 14.
Figure 19:
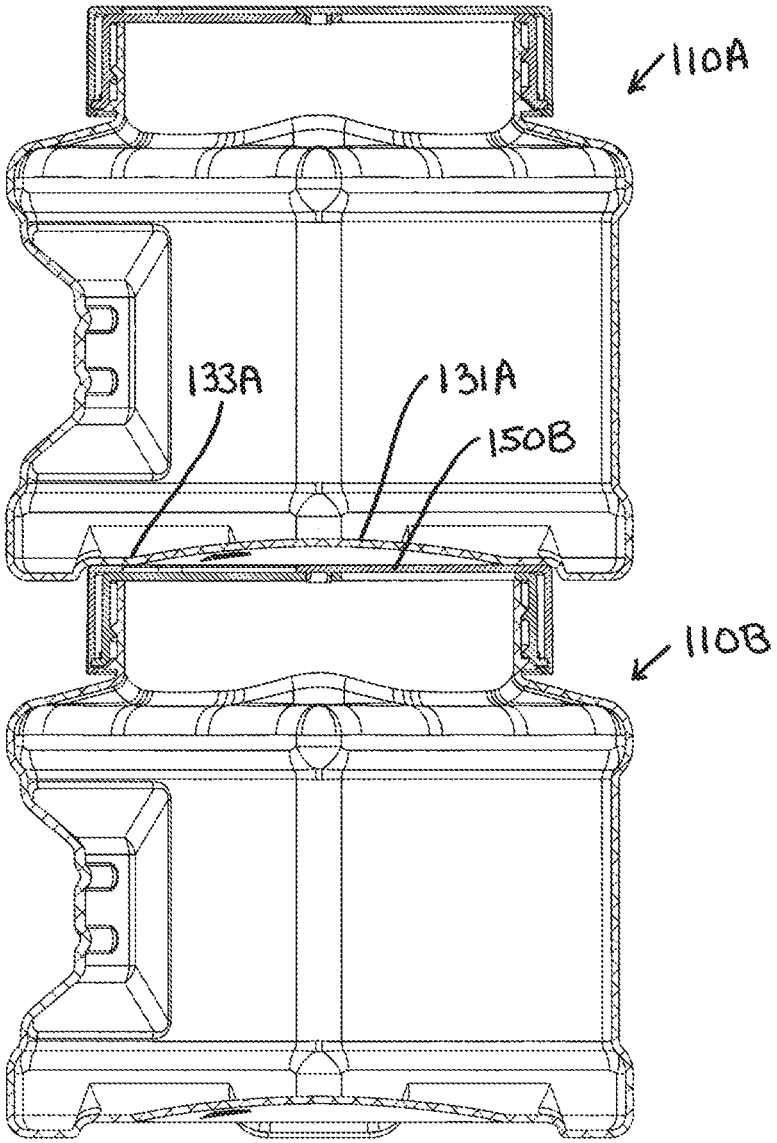
FIG. 19 is cross-section of the stacked container assemblies taken along a plane through opposite corners of the jars.

A pair of stacked container assemblies 110A and 110B are show in FIG. 18, with feet 132A of the upper container assembly 110A extend downward alongside the lid assembly 124B of the lower container assembly 110B. As seen in the FIG. 19 partial cross-section of the stacked container assemblies 110A and 110B, when stacked, the rim 133A of the bottom wall of the upper container assembly 110A sits atop a perimeter portion of the top wall 150B of the outer lid component of the lower container assembly 110B, and the domed section 131A of the bottom wall of the upper container assembly is raised above the flat top wall 150B of the lower container assembly.

Still other variations and configurations are possible.

What is claimed is:

1. A container assembly for holding items and permitting selective removal of items therefrom, comprising:

a jar including a body portion defining an interior space for holding items and an upper neck portion disposed about a jar opening leading to the interior space, the upper neck portion including an exterior thread arrangement;

a lid assembly threadedly connected onto the upper neck portion of the jar so as to be removable by unthreading, the lid assembly including an inner lid component and an outer lid component, the outer lid component rotatable relative to the inner lid component;

wherein the inner lid component includes a first top portion and a first mount collar portion, the first mount collar portion extending downward from the first top portion and having an interior thread arrangement engaged with the exterior thread arrangement of the upper neck portion of the jar;

wherein the first top portion at least partly covers the jar opening and includes a first access opening providing a path through the jar opening;

wherein the outer lid component includes a second top portion and a second mount collar portion, the second mount collar portion extending downward from the second top portion and disposed about the first mount collar portion;

wherein the second top portion includes a second access opening having an area that is substantially the same as an area of the first access opening, the outer lid component is rotatable relative to the inner lid component for movement between an item dispense position and an item retain position, in the item dispense position the second access opening at least partially overlaps with the first access opening to provide access to the interior space of the jar, in the item retain position the second access opening does not overlap with the first access opening such that the jar opening is completely covered by the lid assembly;

wherein the first mount collar portion includes an outwardly projecting first stop, an outwardly projecting second stop and an outwardly projecting detent, the second mount collar portion includes an inwardly projecting first stop and an inwardly projecting second stop, wherein in the item dispense position of the outer lid component the first stop of the outer lid component engages the first stop of the inner lid component.

2. The container assembly of claim 1 wherein the second mount collar portion includes a plurality of circumferentially spaced apart and inwardly extending tabs disposed beneath a lower portion of the first mount collar portion to retain the inner lid component within the outer lid component.

3. The container assembly of claim 2 wherein the lower portion of the first mount collar portion is formed in part by a radially outwardly projecting peripheral rim toward a bottom of the first mount collar portion.

4. The container assembly of claim 3 wherein the second mount collar portion includes an inner rim having a lower side adjacent a top side of the radially outwardly projecting peripheral rim such that the radially outwardly projecting peripheral rim is sandwiched between the inner rim and the tabs.

5. The container assembly of claim 1 wherein the second top portion includes a pin component projecting downwardly therefrom and disposed within an additional opening of the first top portion.

6. The container assembly of claim 1 wherein, when the outer lid component is in the item retain position (i) the second stop of the outer lid component is disposed between the detent of the inner lid component and the second stop of the inner lid component and (ii) when progressing in a first rotational direction that would move the outer lid component from the item retain position to the item dispense position, the detent of the inner lid component is positioned between second stop of the outer lid component and the first stop of the inner lid component.

7. The container assembly of claim 6 wherein the first stop of the inner lid component includes a first stop surface that angles away from the first rotational direction, the first stop of the outer lid component includes a first stop surface that angles toward the first rotational direction.

8. The container assembly of claim 1 wherein the second stop of the inner lid component includes a second stop surface that angles toward the first rotational direction, the second stop of the outer lid component includes a second stop surface that angles away from the first rotational direction.

9. The container assembly of claim 1 wherein the first stop of the outer lid component cannot be moved into contact with the second stop of the inner lid component.

10. The container assembly of claim 1 wherein the jar includes a bottom surface portion that is substantially planar, and a plurality of feet extending downwardly below the bottom surface portion, wherein the plurality of feet are arranged to permit stacking of container assemblies in such a manner that the feet of an upper container assembly extend downward alongside the lid assembly of a lower container assembly.

11. The container assembly of claim 10 wherein the feet are located at corners of the jar.

12. A container assembly for holding items and permitting selective removal of items therefrom, comprising:

a jar including a body portion defining an interior space for holding items and an upper neck portion disposed about a jar opening leading to the interior space;

a lid assembly connected onto the upper neck portion of the jar, the lid assembly including an inner lid component and an outer lid component;

wherein the inner lid component includes a top wall partially covering the jar opening and having an access opening therein;

wherein the outer lid component includes a top wall partially covering the jar opening and having an access opening therein;

wherein the outer lid component is rotatable relative to the inner lid component between an item dispense position and an item retain position, in the item dispense position the access opening of the outer lid component at least partially overlaps with the access opening of the inner lid component to provide access to the interior space of the jar, and in the item retain position the access opening of the outer lid component does not overlap with the access opening of the inner lid component such that the jar opening is completely covered by the lid assembly;

wherein the inner lid component includes a peripherally outer mount collar engaged with the neck portion of the jar, and the outer lid component includes a peripherally outer mount collar disposed about the mount collar of the inner lid component;

wherein the mount collar of the inner lid component includes an outwardly projecting first stop, an outwardly projecting second stop and an outwardly projecting detent, and the mount collar of the outer lid component includes an inwardly projecting first stop and an inwardly projecting second stop;

wherein, in the item dispense position of the outer lid component, the first stop of the outer lid component engages the first stop of the inner lid component.

13. The container assembly of claim 12 wherein the lid assembly is removable from the jar, and the outer lid component includes a plurality of inwardly extending tabs that extend beneath respective parts of the mount collar of the inner lid component to retain the inner lid component within the outer lid component when the lid assembly is removed.

14. The container assembly of claim 12 wherein, when the outer lid component is in the item retain position (i) the second stop of the outer lid component is disposed between the detent of the inner lid component and the second stop of the inner lid component and (ii) when progressing in a first rotational direction that would move the outer lid component from the item retain position to the item dispense position, the detent of the inner lid component is positioned between the second stop of the outer lid component and the first stop of the inner lid component.

15. The container assembly of claim 14 wherein the first stop of the inner lid component includes a first stop surface that angles away from the first rotational direction, and the first stop of the outer lid component includes a first stop surface that angles toward the first rotational direction.

16. The container assembly of claim 15 wherein the second stop of the inner lid component includes a second stop surface that angles toward the first rotational direction, the second stop of the outer lid component includes a second stop surface that angles away from the first rotational direction.

* * * * *